US006836616B2

(12) United States Patent
Jamison et al.

(10) Patent No.: US 6,836,616 B2
(45) Date of Patent: Dec. 28, 2004

(54) MOLTEN MATERIAL APPLICATION MACHINE

(75) Inventors: Chris M. Jamison, West Chester, OH (US); Daniel J. Davidson, Milford, OH (US)

(73) Assignee: Valco Cincinnati, Inc., Cincinnati, OH (US)

( * ) Notice: Subject to any disclaimer, the term of this patent is extended or adjusted under 35 U.S.C. 154(b) by 0 days.

(21) Appl. No.: 10/365,914

(22) Filed: Feb. 13, 2003

(65) Prior Publication Data

US 2003/0180035 A1 Sep. 25, 2003

Related U.S. Application Data

(60) Provisional application No. 60/356,869, filed on Feb. 14, 2002.

(51) Int. Cl.[7] ..... F24H 1/08

(52) U.S. Cl. ..... 392/471; 219/421

(58) Field of Search ..... 392/441, 449, 392/471, 473; 219/213, 215, 420, 421, 424, 441

(56) References Cited

U.S. PATENT DOCUMENTS

| | | | | |
|---|---|---|---|---|
| 3,779,426 A | | 12/1973 | Mawby | 222/146 |
| 3,895,614 A | | 7/1975 | Bailey | 123/67 |
| 4,092,089 A | | 5/1978 | Böcker et al. | 425/10 |
| 4,286,432 A | | 9/1981 | Burrows et al. | 60/404 |
| 5,003,916 A | | 4/1991 | Donley | 118/429 |
| 5,014,599 A | | 5/1991 | Kocsis et al. | 92/84 |
| 5,779,854 A | | 7/1998 | Sandmeier | 156/578 |
| 5,918,464 A | | 7/1999 | Pape et al. | 60/565 |
| 5,961,721 A | | 10/1999 | Feldkamper et al. | 118/222 |
| 5,974,227 A | | 10/1999 | Schave | 392/478 |
| 6,046,437 A | * | 4/2000 | Frates | 219/426 |
| 6,184,496 B1 | * | 2/2001 | Pearce | 219/213 |

FOREIGN PATENT DOCUMENTS

DK 0771632 B1 8/1996

* cited by examiner

*Primary Examiner*—Thor Campbell
(74) *Attorney, Agent, or Firm*—Frost Brown Todd LLC

(57) ABSTRACT

The present invention generally relates to a hot molten adhesive application machine. More specifically the present invention discloses a unique hot melt adhesive application machine having a novel construction whereby the reservoir of molten adhesive material is heated from within the molten adhesive. The adhesive pump, discharge hoses, and discharge applicators are heated by electrical resistance heating elements that may operate on 120 or 240 volt current. Further, a novel axial pump piston is disclosed whereby the pump cylinder bore may be machined to a lessor tolerance standard than previous pumps of this type.

23 Claims, 14 Drawing Sheets

MOLTEN MATERIAL APPLICATION MACHINE

RELATED APPLICATIONS

This application claims the priority of Provisional Patent Application Ser. No. 60/356,869 filed on Feb. 14, 2002.

BACKGROUND OF THE INVENTION

The present invention generally relates to a hot melt adhesive application machine. More specifically the present invention discloses a novel method and apparatus for supplying heat to the molten adhesive reservoir and providing heat to the molten adhesive discharge hoses and applicators. Further a unique and novel heated adhesive piston displacement pump mechanism is taught whereby the cost of manufacture of the pump has been reduced.

Heretofore, hot melt adhesive application machines basically comprised a heated reservoir from which the molten adhesive was removed by a piston displacement pump manufactured to exacting tolerances. In such a system the reservoir container is directly heated by any convenient means, whereby heat transfer is, by conduction, from the reservoir container into the reservoir of adhesive material. Therefore the reservoir must be maintained at a temperature above that of the molten adhesive to maintain heat flow into the molten adhesive since heat can only flow from a high temperature to a lower temperature. Since the reservoir container will typically comprise a relatively large surface area the reservoir shell represents a large heat conducting and/or radiating surface. Thus the outer surface of the reservoir shell must be heavily insulated to minimize heat loss from the reservoir to the surrounding environment. Nevertheless, heat will be lost to the surrounding environment.

Prior art hot melt adhesive application machines typically include electrical resistance heating elements within their supply hoses and applicators to prevent undesirable heat loss from the molten adhesive as it is conveyed from the pumping mechanism to the applicator. However, the typical prior art hot melt adhesive application machine discharge hose and applicators are manufactured to operate on, and are committed to operate on 120 or 240 volt electrical supply systems but not both. Therefore a manufacturer and/or supplier of such equipment must, necessarily, stock machines, discharge hoses and applicators, that operate on one or the other electrical systems.

SUMMARY OF THE PRESENT INVENTION

The present invention overcomes the above described disadvantages of prior art hot melt adhesive application machines.

The present invention teaches an electrically heated main displacement pump body that is partially submerged within the molten adhesive material thereby eliminating the necessity of heating the outside shell of the reservoir. By this technique heat from the submerged pump body first passes, by conduction, into the molten adhesive material and then to the reservoir outer shell. Thus, in heat transfer terms, the reservoir outer shell is the coolest part of the system thereby requiring less insulating material to prevent unnecessary heat loss to the surrounding environment. By the present invention the reservoir container may now be made of a material having a lower heat transfer conductivity than the metal containers of the prior art. For example, the molten adhesive reservoir might be made of a low conductivity resinous material or ceramic.

A further novel feature of the present invention is that the hot melt adhesive pump body, each hot melt supply hose and associated discharge applicator is separately heated by electric resistance heating circuits that may selectively operate on 120 volt or 240 volt AC current.

DETAILED DESCRIPTION OF THE PREFERRED EMBODIMENT

Figure 1:
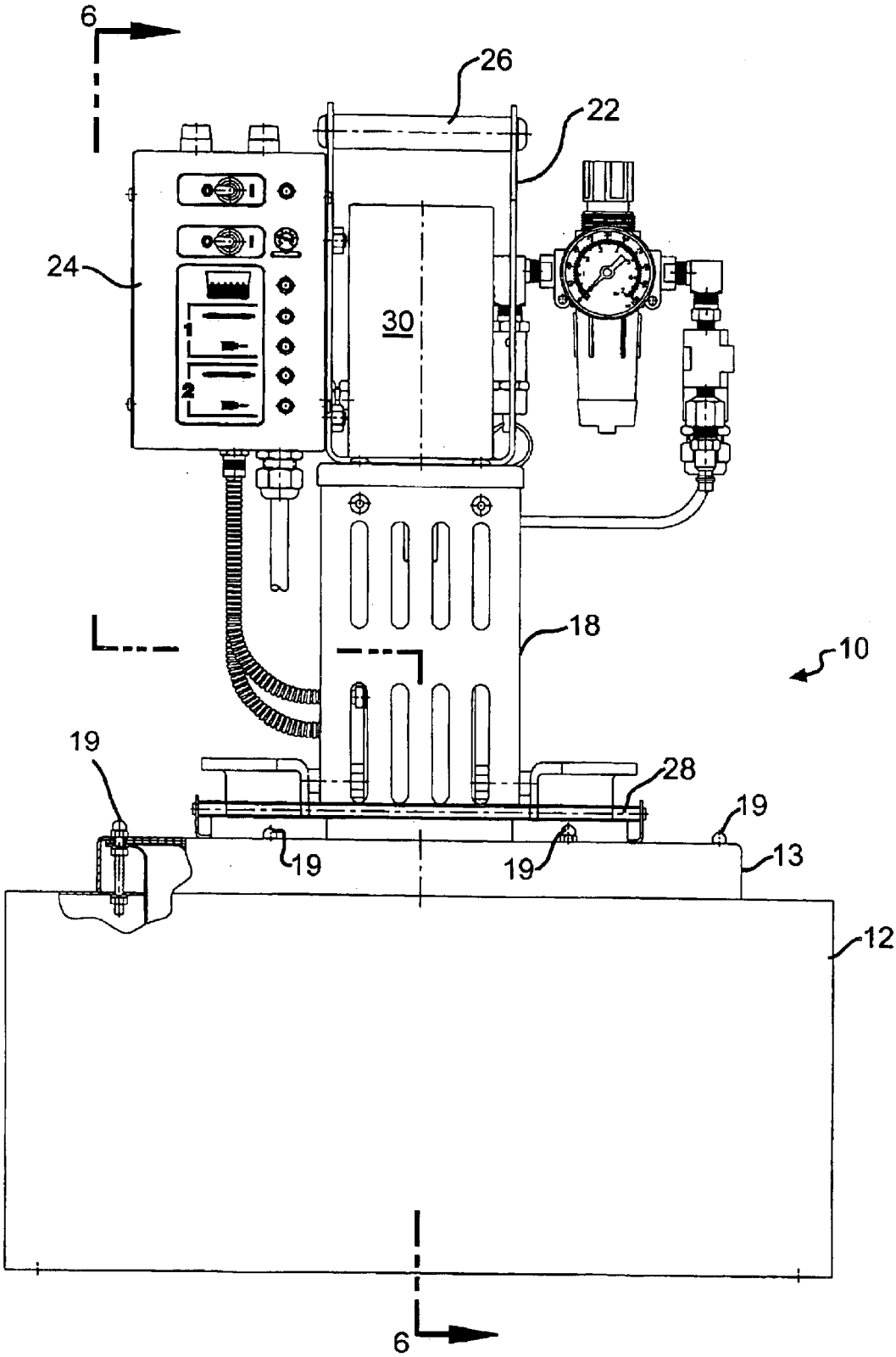
FIG. 1 presents a front elevational view of a hot melt adhesive applying machine embodying the present invention.
Figure 2:
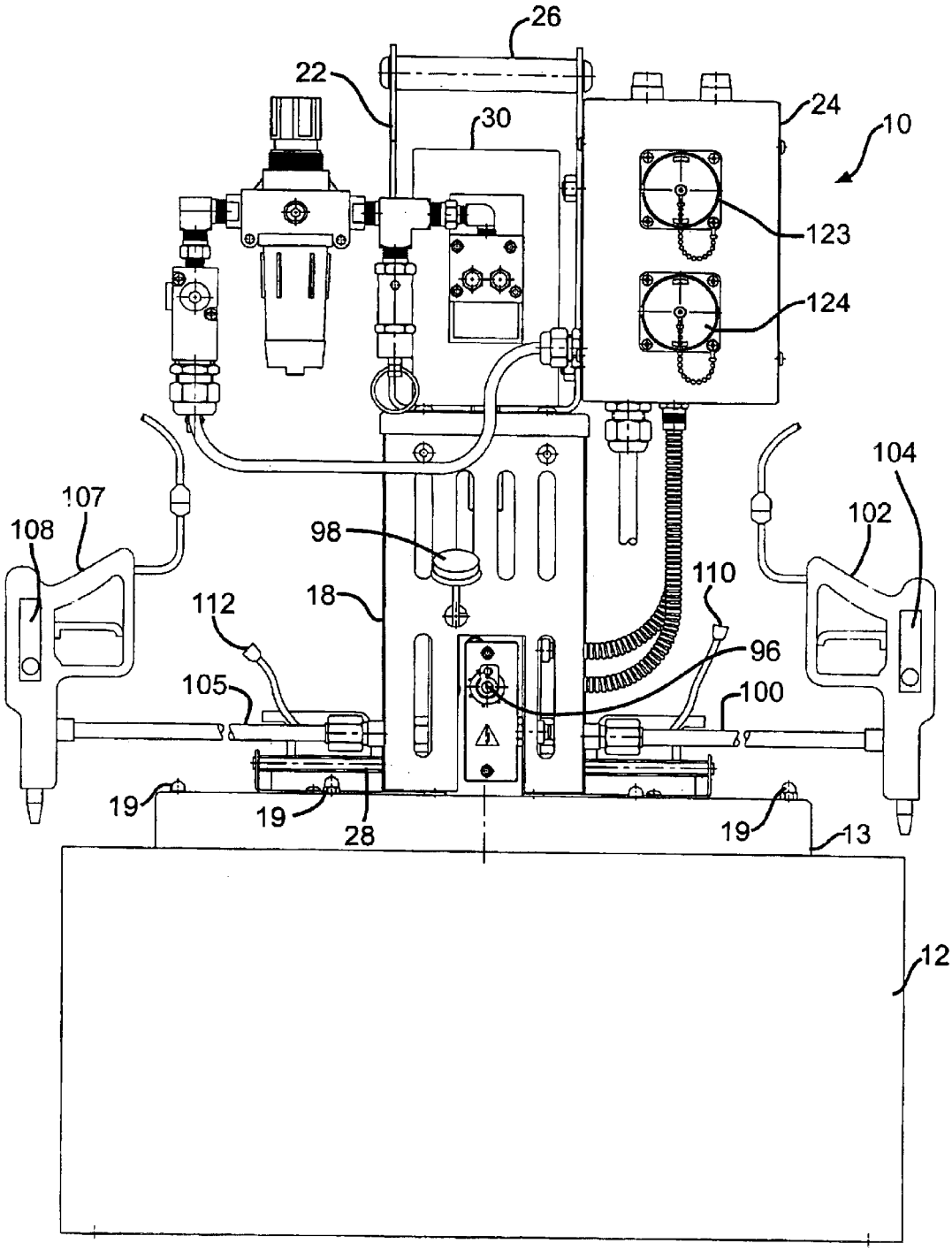
FIG. 2 presents a rear elevational view of the hot melt adhesive applying machine of FIG. 1.
Figure 3:
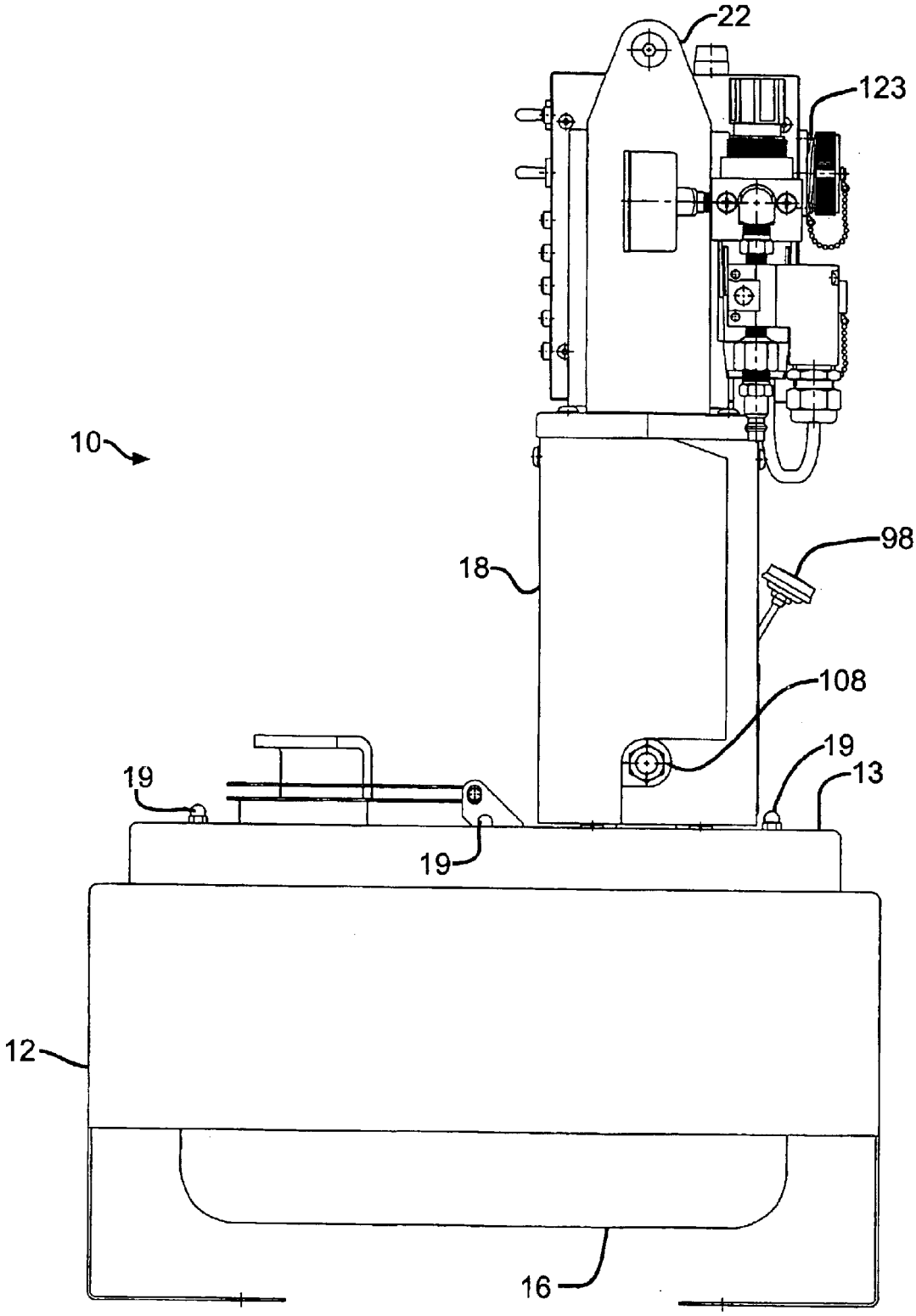
FIG. 3 presents a left side elevational view of the hot melt adhesive applying machine of FIG. 1 with discharge hose and applicator removed.
Figure 6:
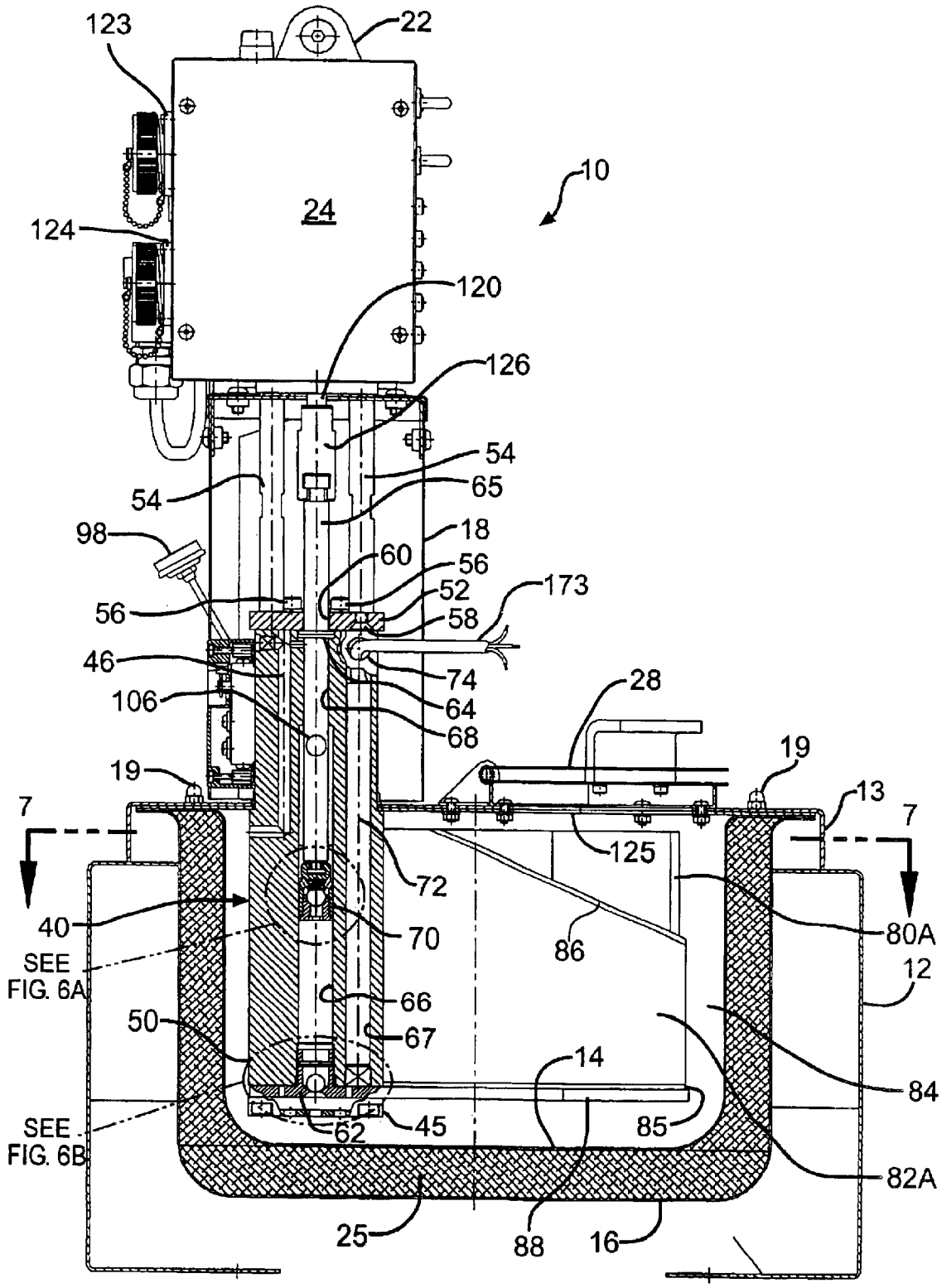
FIG. 6 presents a crossectional view taken along line 6—6 in FIG. 1.

Referring generally to FIGS. 1 through 6, a hot melt adhesive application machine 10 is illustrated comprising a base frame or supporting stand 12 having a top cover 13 attached to base 12 by a multiplicity of nuts and bolts 19 as illustrated in the cutaway portion of top cover 13 in FIG. 1. An open top, adhesive reservoir 14 having an outer reservoir shell 16 is suspended from top cover 13 as best seen in FIG. 6. Thermal insulating material 25 is placed between reservoir 14 and shell 16 to reduce heat loss from the molten adhesive within reservoir 14. Extending upward from top cover 13 is safety guard 18. Positioned above safety guard 18 is a U shaped mounting bracket 22 having main control box 24 attached thereto. Mounting bracket 22 includes a handle 26 for lifting and/or carrying machine 10. A hinged lid 28 is provided atop opening 125, within the top cover 13, for loading solid, hot melt adhesive into reservoir 14 as shown in FIG. 6.

Figure 8:
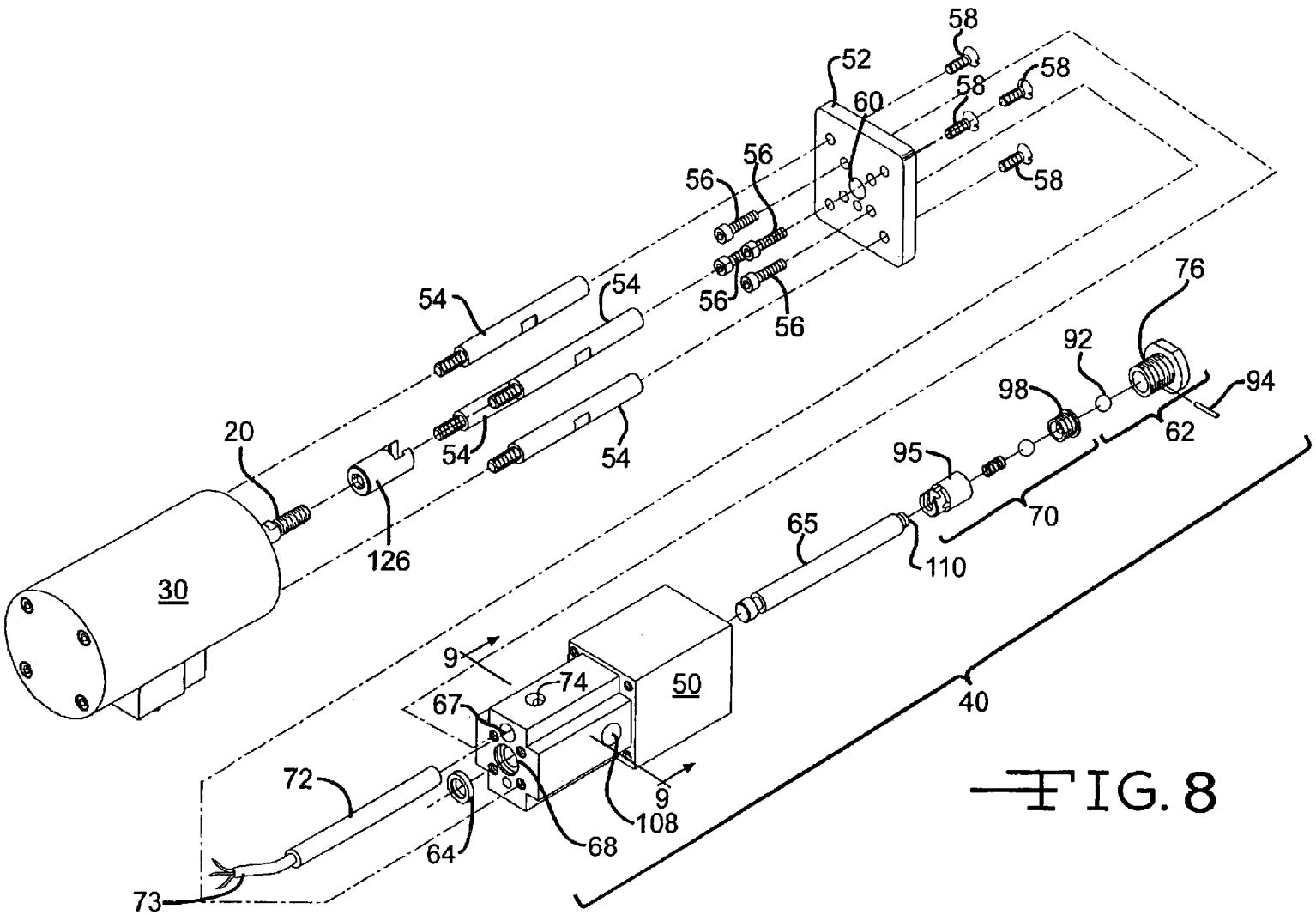
FIG. 8 presents an exploded, isometric, pictorial view of the air motor/pump assembly removed form the hot melt adhesive application machine.

FIG. 8 presents an exploded isometric pictorial of the air motor/pump assembly within machine 10. Air motor 30 is affixed to the top plate 52 of the pump body assembly 40 by four stanchions 54 as seen in FIGS. 6 and 8. Stanchions 54 are threaded into the body of air motor 30 and attached to top plate 52 by four flat headed, threaded fasteners 58. Pump body 50 is affixed to the opposite side of plate 52 by four socket-headed screws 56 as illustrated in FIGS. 6 and 8. Prior to attaching plate 52 to pump body 50, pump body 50 is first attached to top cover 13 by four socket-head screws 36 as illustrated in the cutaway portion in FIG. 4. Although an air motor is disclosed herein, any suitable means of driving pump assembly 40, such as an electric motor may also be used.

Figure 4:
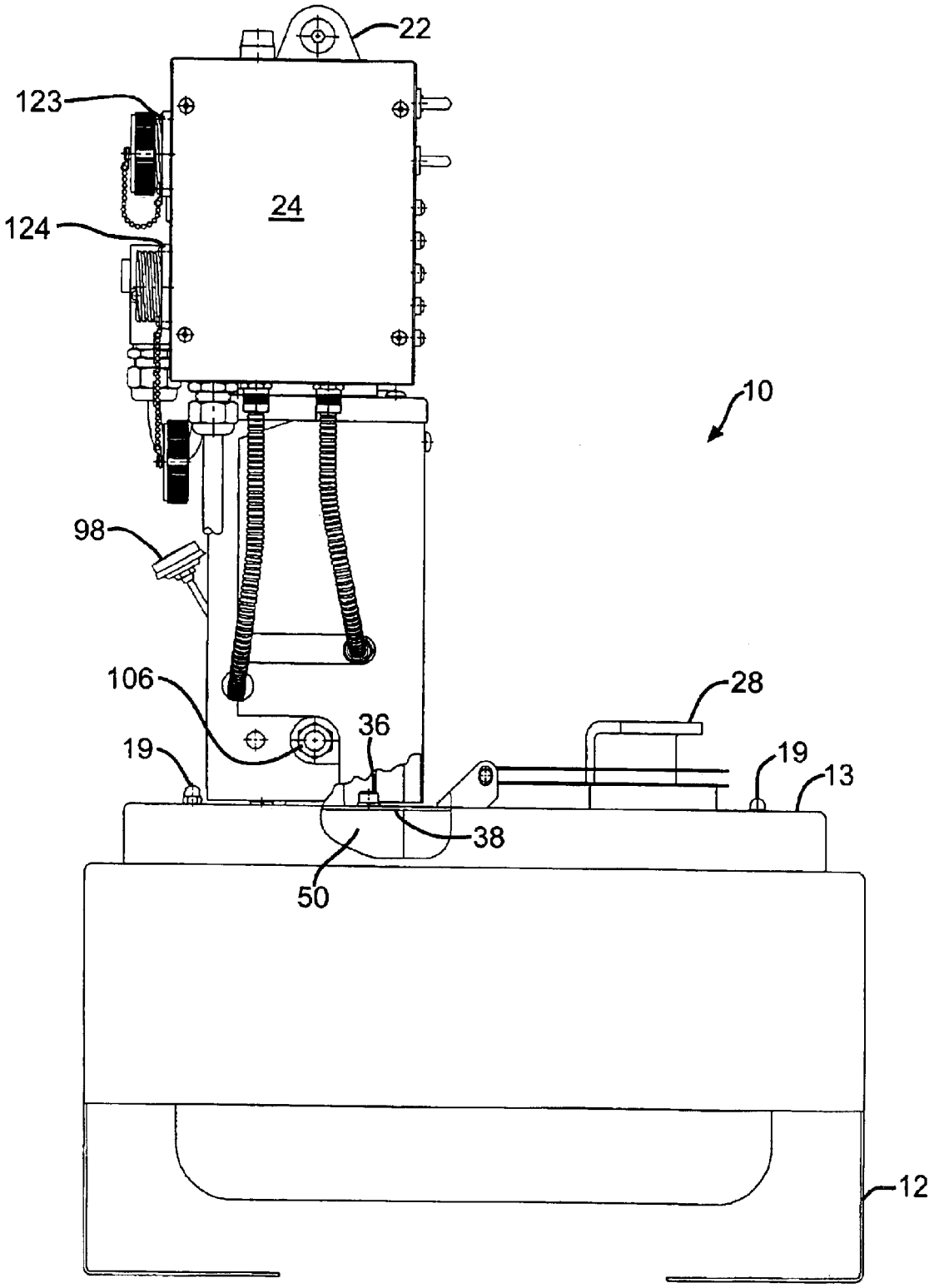
FIG. 4 presents a right side elevational view of the hot melt adhesive applying machine of FIG. 1 with discharge hose and applicator removed.
Figure 5:
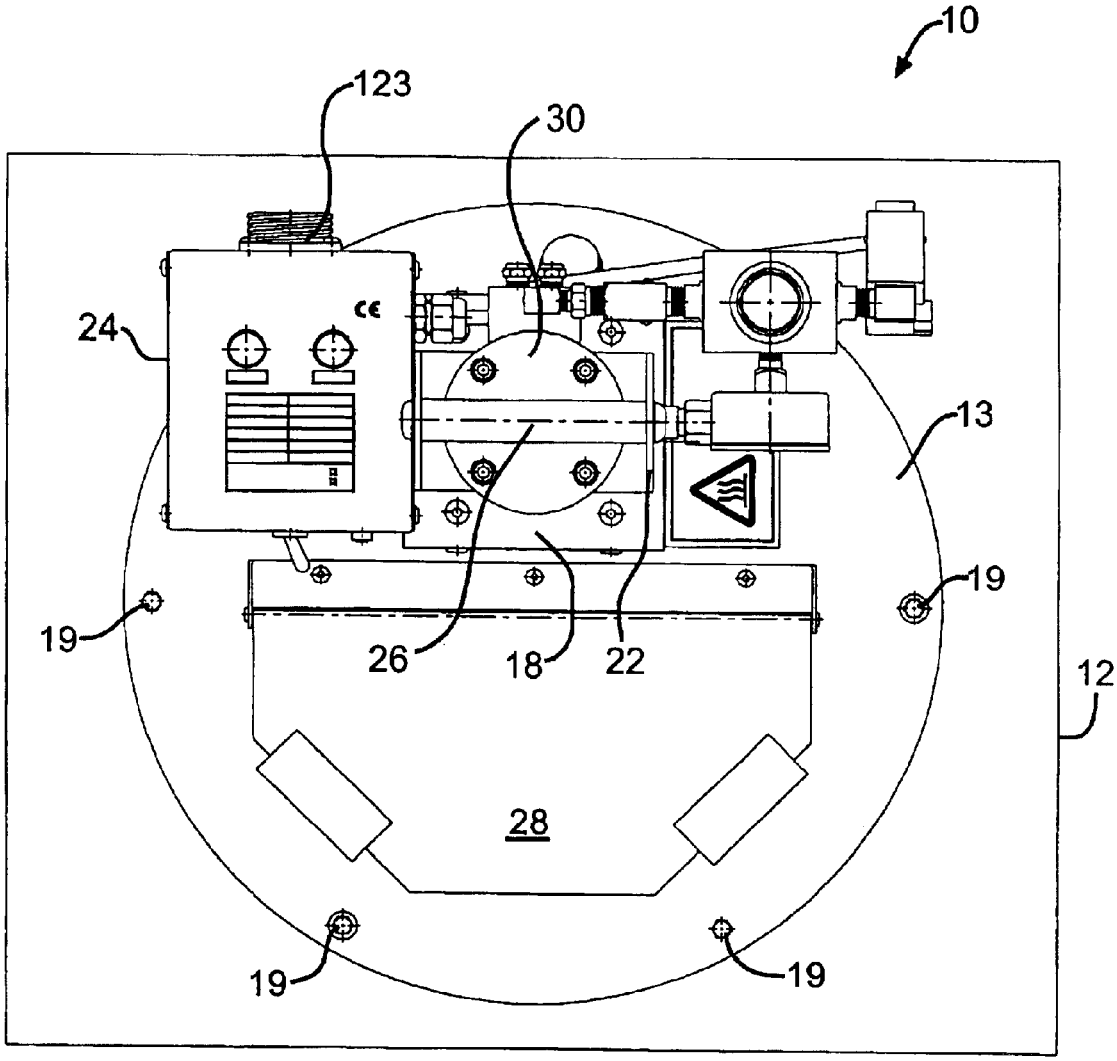
FIG. 5 presents a top plan view of the hot melt adhesive applying machine of FIG. 1 with discharge hose and applicator removed.
Figure 9:
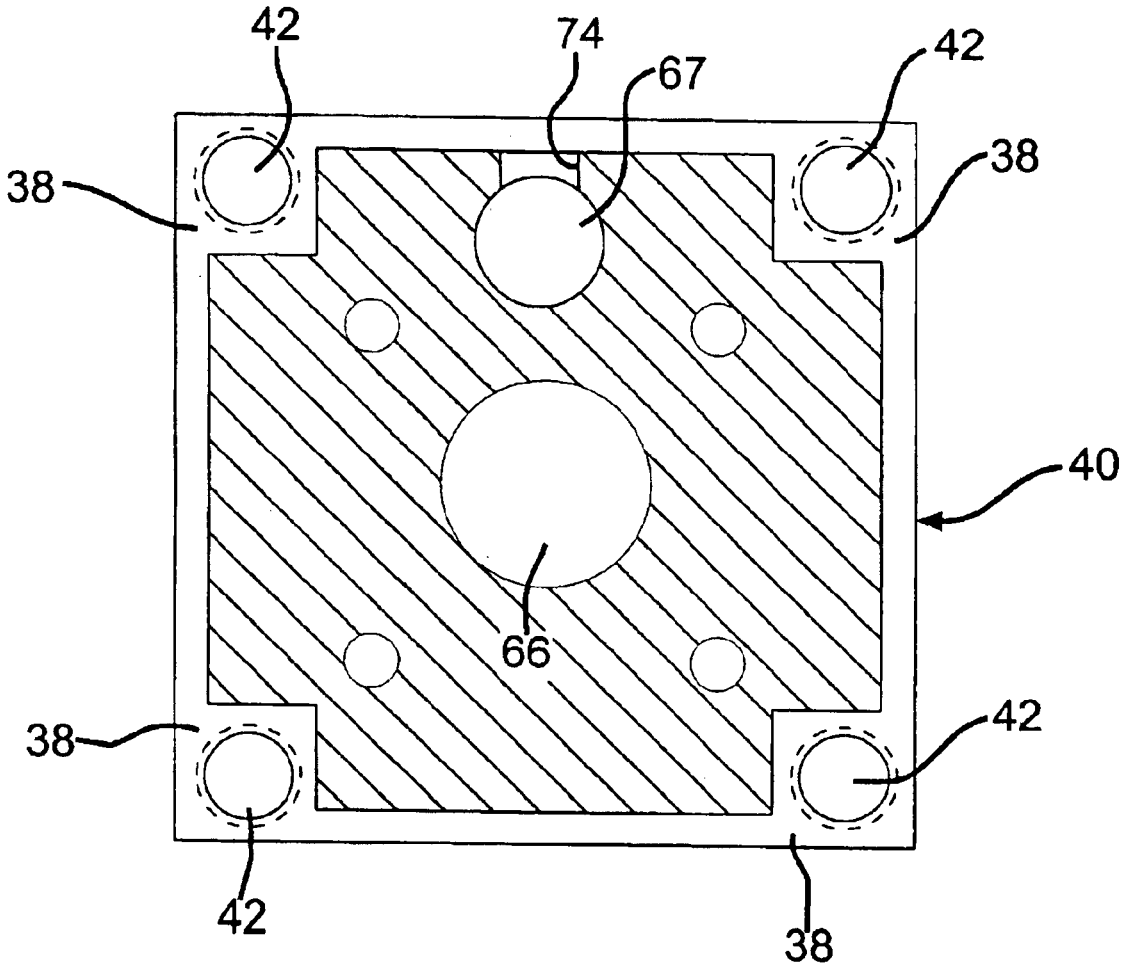
FIG. 9 presents a crossectional view taken along line 9—9 in FIG. 8.

As best illustrated in FIGS. 6, 8, and 9, the top portion of the pump body's four comers are, machined away as best illustrated in FIG. 9 thereby creating four flat land areas 38 into which a threaded bore 42 is provided for attaching pump body 50 to top cover 13 with four socket-head screws 36 as illustrated in the cut-away portion of FIG. 4.

Figures 8A, 8B, 8C:
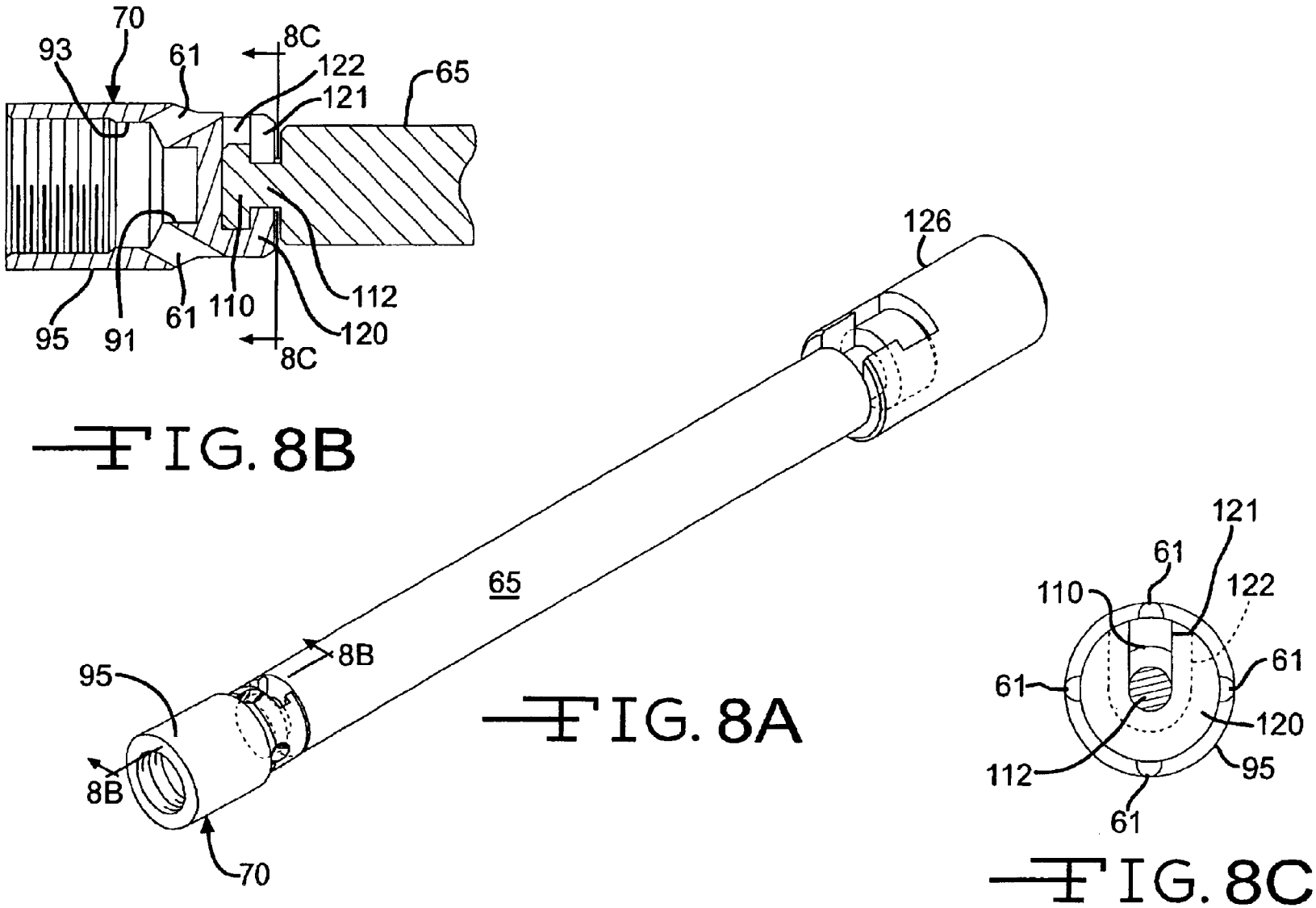
FIG. 8A presents an isometric, pictorial view of the pump rod/piston assembly removed from the pump body.
FIG. 8B is a crossectional view taken along line 8B—8B in FIG. 8A.
FIG. 8C presents an elevational view taken along line 8C—8C in FIG. 8B.

An opening 60 is provided, within plate 52, through which pump rod 65 passes and attaches to air motor driving rod 20 by coupling 126 as illustrated in FIG. 6. A pump piston assembly 70 is attached to the opposite end of pump rod 65 as illustrated in FIG. 8A and is received within pump bore 66 as illustrated in FIG. 6. Threaded into the bottom opening of pump bore 66 is pump check valve assembly 62. A seal 64 is provided at the top of pump rod bore 68 sealingly engaging pump rod 65 as pump rod 65 reciprocates within pump rod bore 68. A blind heater bore 67 is provided within pump body 50 receiving therein resistance-heating element 72. Side opening 74, within pump body 50 is provided for exit of the heating element feed wires 73 which are connected to pump body temperature control 96. The temperature setting desired for the pump body is manually set as appropriate for the particular adhesive within reservoir 14. For reference and control purposes a pump body thermometer 98 is provided to give a continuous read-out of the pump body temperature. Thermometer 98 is a simple typical stem type thermometer inserted into a stem receiving bore within the pump body (not shown).

Referring now to FIGS. 8, 8A, 8B, and 8C, pump rod 65 is attached to air motor 30, at its top end, by coupling 126 and to piston assembly 70 at its bottom end. The main body 95, of piston assembly 70, includes, at its top end, a side opening slot 122. A second, more narrow "key way slot" 121 is cut into the top cover 120 of slot 122. Key way slot 121 generally parallels slot 122. The bottom end of pump rod 65 terminates with a circular knob 110 extended from said pump rod by a small diameter neck 112. When piston assembly 70 is connected to pump rod 65 knob 110 slides into slot 122 with neck 112 being received within slot 121. Thus piston assembly 70 has a small degree of freedom to move in a lateral direction but is not free to move axially with respect to pump rod 65. This lateral freedom of movement by piston assembly 70 permits piston assembly 70 to self align within pump bore 66 as it translates axially therein. Coupling 126 connects air driving rod 20 to the opposite end of pump rod 65 in a similar manner as that used to connect piston assembly 70.

Extending outward from either side of pump body 50 is at least one heated and insulated, molten adhesive supply hose 100 (see FIG. 2) connecting to a separately heated adhesive applicator 102. A second heated and insulated supply hose 105 and heated applicator 107 may also be provided. Supply hoses 100 and 105 are threadedly connected to pump discharge outlets 106 and 108 as shown in FIGS. 6 and 8. Supply hoses 100 and 105, and applicators 102 and 107 each have separate thermostatically controlled heating elements therein which will be discussed in further detail below.

Applicators 102 and 107 each include separate, manually adjustable, thermostatic controls 104 and 108 for controlling the temperature of the applicator. Supply hoses 100 and 105 each include separate thermostatic controls 110 and 112 having two preset positions, "HIGH" and "LOW." However, if desired supply hoses 100 and 105 could be provided with manually controlled thermostatic controls as those provided on applicators 102 and 107.

Figure 7:
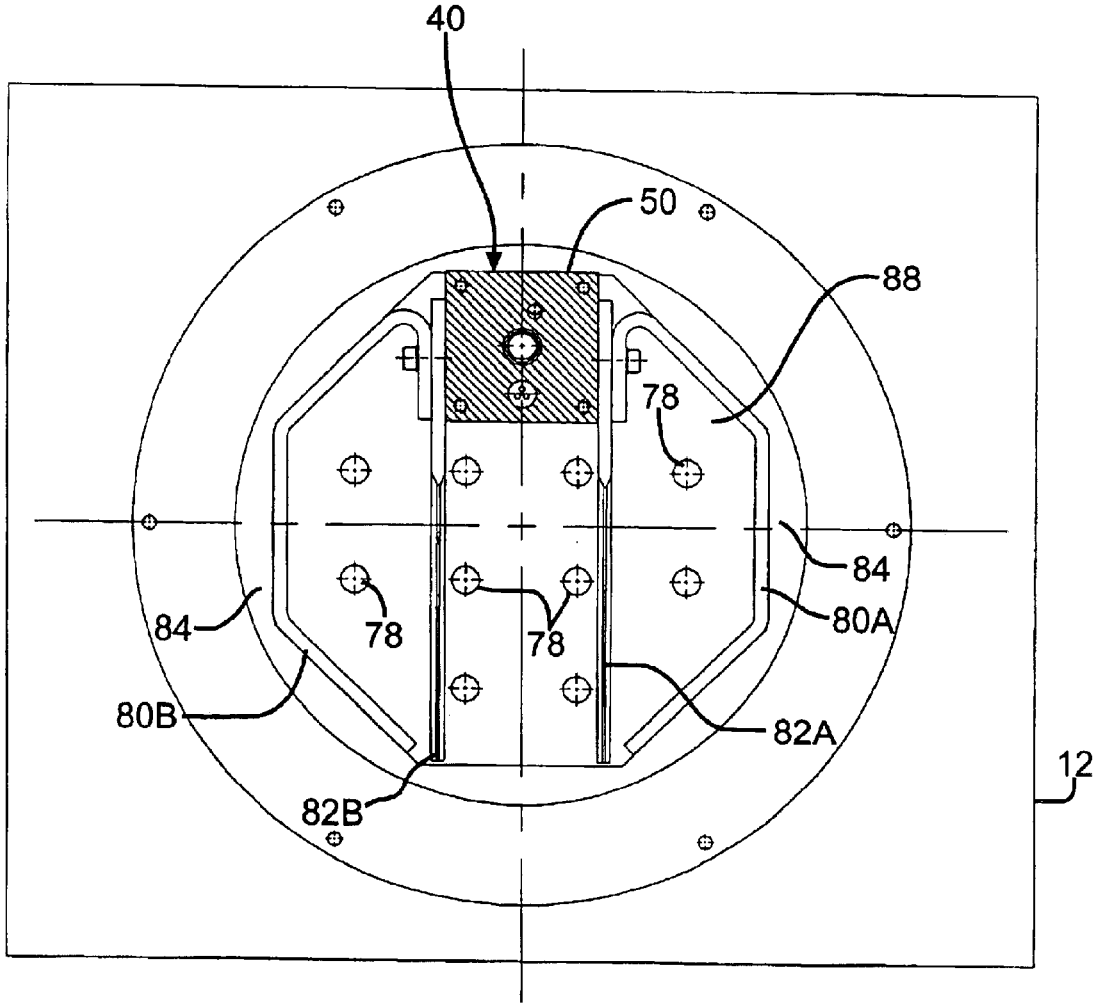
FIG. 7 presents a crossectional view taken along line 7—7 in FIG. 6.

Referring now to FIGS. 6 and 7, attached to pump body 50 are heat transfer fins 80A, 80B 82A and 82B as best seen in FIG. 7. As illustrated in FIG. 7, heat transfer fins 80A and 80B generally circumscribe the inner periphery of reservoir 14 maintaining a nominal distance or clearance 84 from the inside surface of reservoir 14. Heat transfer fins 80 may be configured hexagonally as illustrated in FIG. 7, or may be curved so as to maintain a constant distance 84 from the inside surface of reservoir 14. Heat transfer fins 80A, 80B, 82A, and 82B are attached to pump body 50 such that heat energy will be conveyed, by conduction, from pump body 50 into and throughout heat transfer fins 80A, 80B, 82A, and 82B. Thermal energy is then transferred, by conduction, from heat transfer fins 80A, 80B, 82A, and 82B into the adhesive within reservoir 14. Preferably heat transfer fins 82A and 82B have a tapered top edge 86 including a "knife edge" profile for severing large pieces of solid adhesive that may be added to reservoir 14 during use of machine 10.

Extending horizontally below heat transfer fins 80A, 80B, 82A, and 82B and generally parallel to the bottom surface of reservoir 14 is plate 88. Octagonally shaped plate 88 is attached to the bottom of pump body 50 by any suitable manner, such as threaded screws. Heat transfer fins 80A, 80B, and bottom plate 88 generally form a heated supply hopper, having dividers 82A and 82B therein, into which solid adhesive shapes may be added for melting. A multiplicity of apertures 78 are provided to permit molten adhesive to pass therethrough and into the molten adhesive reservoir. A gap 85 is also preferred between the bottom of heat transfer fins 80, 82, and bottom plate 88 for passage of molten adhesive into the molten adhesive reservoir.

Figure 6A:
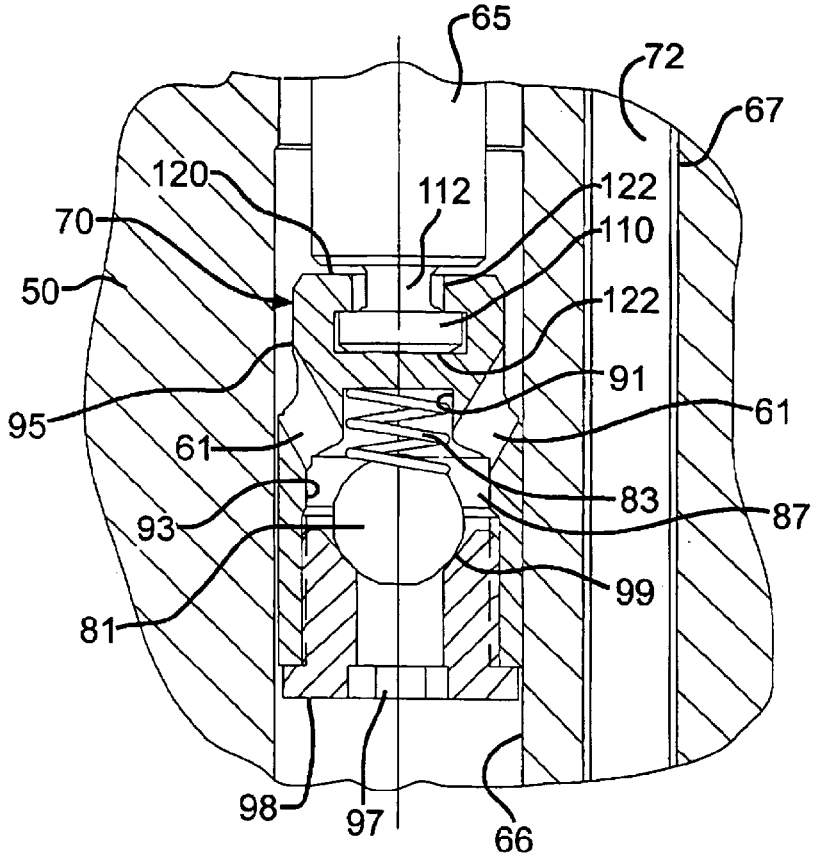
FIG. 6A is an enlarged crossection of the encircled area 6A in FIG. 6.
Figure 6B:
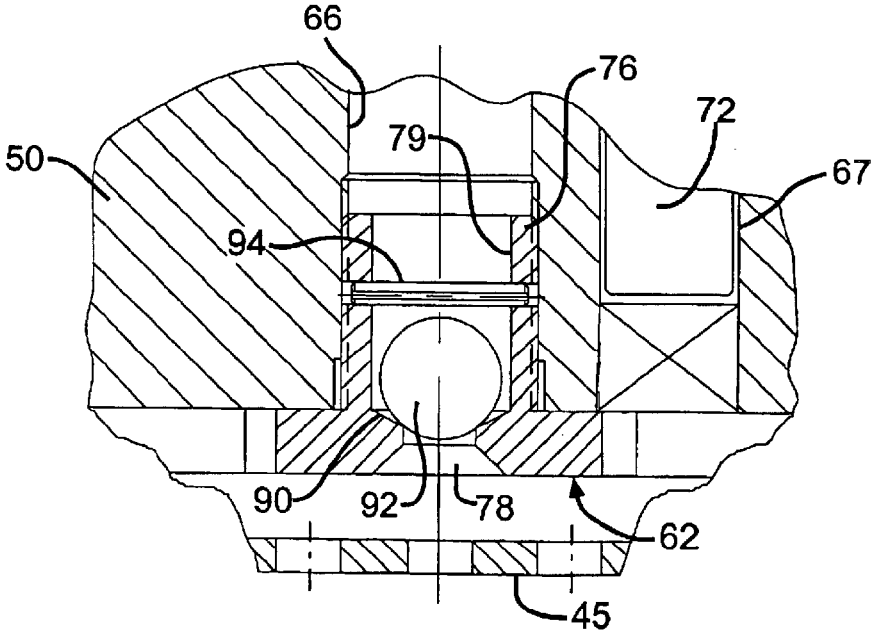
FIG. 6B is an enlarged crossection of the encircled area 6B in FIG. 6.

FIG. 6B presents an enlarged crossectional view of pump inlet check valve assembly 62 as installed at the bottom of pump bore 66. Check valve assembly 62 comprises an inlet fitting 76 extending upward into the inlet end of pump bore 66. An inlet passage extends axially through fitting 76 comprising a first bore 78 diverging into a larger diameter second bore 79. At the juncture of bore 78 and bore 79 a ball seat 90 is provided for receiving therein ball 92. A diametrically extending roll pin 94 is provided to retain ball 92 within check valve assembly 62. Thus a simple ball check valve is provided within the inlet end of pump bore 66 whereby fluid (molten adhesive) may flow into pump bore 66, as piston assembly 70 moves upward, but is prevented from flowing out of pump bore 66 as piston assembly 70 moves downward. Inlet check valve assembly 62 may be threaded into pump bore 66, installed as a force fitted insert, or any other convenient means. It is preferable to provide an inlet filter 45 (see FIG. 6B) to prevent the entry of any debris, that may have fallen into the adhesive reservoir, from entering check valve assembly 62.

A similar ball check valve is installed within pump piston assembly 70. Referring to FIGS. 6A and 8, piston assembly 70 comprises a main body 95 having an axial central bore 93 therein. Central bore 93 converges into a secondary, blind, axial bore 91. Inserted into central bore 93 is a valve seat fitting 98 having an axial inlet bore 97 terminating with a ball valve seat 99 at its upper end. Positioned between valve seat 99 and secondary bore 91 is ball 81 and compression spring 83 biasing ball 81 toward valve seat 99. At least one fluid passage 61 is provided extending from chamber 87, within piston body 95, into pump bore 66.

In operation, as piston assembly 70 moves downward in pump bore 66, check valve assembly 62 is closed whereby fluid (molten adhesive) forces ball 81, within piston assembly 70, to open thereby permitting fluid to flow through chamber 87 and passage way 61 of piston assembly 70 and into pump bore 66 above piston assembly 70 and around pump rod 65. When piston assembly 70 reverses travel, at bottom dead center, and begins to move upward within pump bore 66, ball valve 81 within piston assembly 70 closes and check valve assembly 62 opens admitting molten adhesive into pump chamber 66 below piston assembly 70. The fluid atop piston assembly 70 is now forced upward, around pump rod 65, exiting pump chamber 66 through fluid exit ports 106 and 108 into hose assemblies 105 and 100 respectively. After reaching top dead center the cycle repeats itself.

Pump rod 65 fits with minimal gap within pump rod bore 68 thereby minimizing by pass flow around pump rod 65. Pressure relief channel 46 redirects any bypass flow back into reservoir 14 (see FIG. 6) thereby reducing hydraulic pressure on seal 64.

In manufacture of pump body 50 pump rod bore 68 is drilled from the top of pump body 50 and pump bore 66 is opposingly drilled from the bottom of pump body 50 whereby both bores meet at mid body. Because of the self aligning attributes of piston assembly 70, the accuracy of aligning the opposingly drilled bores is diminished from that which would be otherwise required for a non self aligning piston assembly. Also use of the above described self aligning piston assembly accommodates manufacturing the pump body in one rather than two or more, axially aligned sections each having the bore therein drilled before assembly of the two sections. Thus, by use of the above described self aligning piston assembly the need for accurately aligning the separate bores during manufacture is greatly diminished as the self aligning piston assembly, having lateral mobility, will accommodate concentricity errors.

Figure 10:
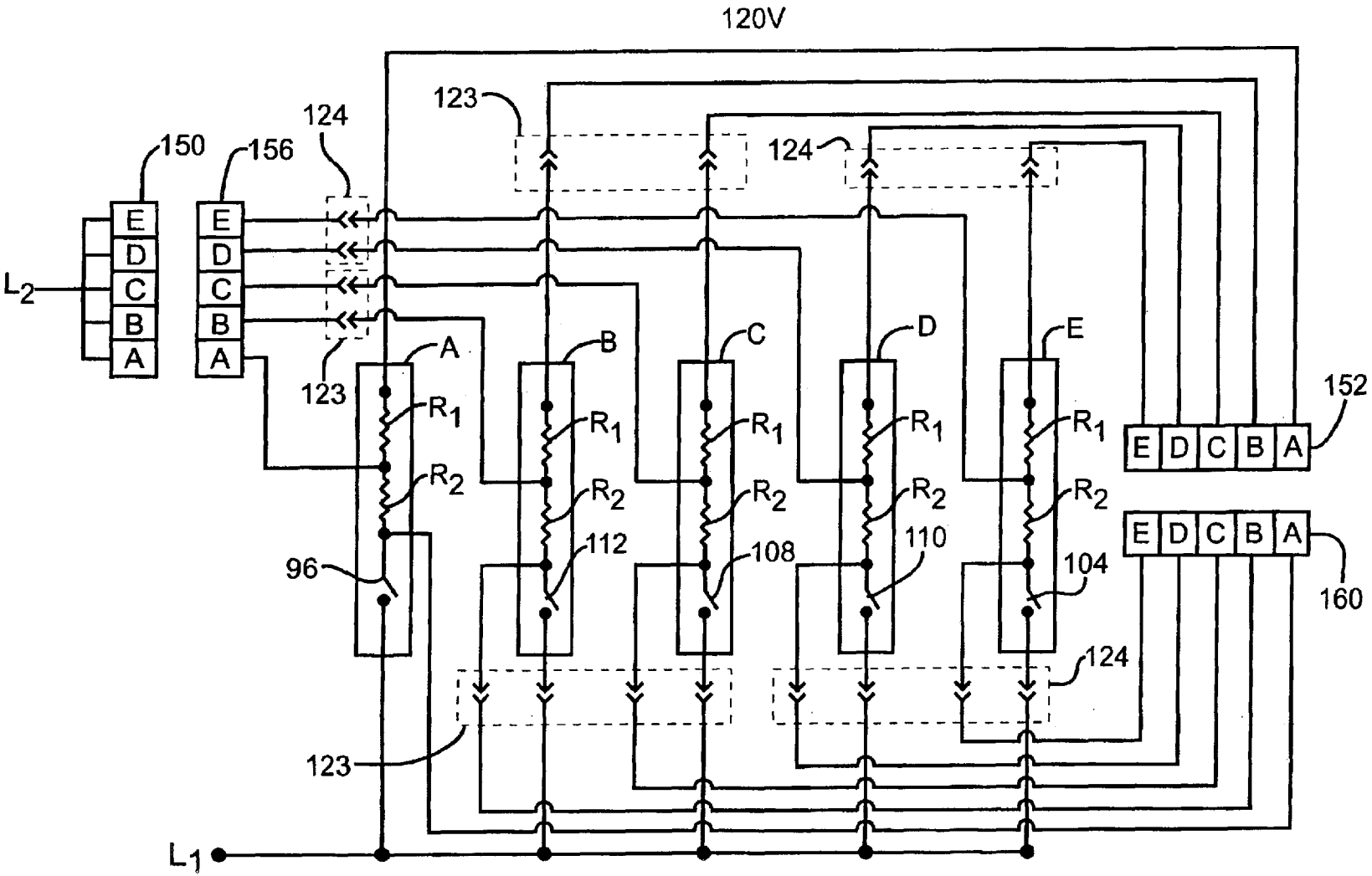
FIG. 10 presents an electrical diagram illustrating the 120 volt operation of the machine heating elements.
Figure 11A:
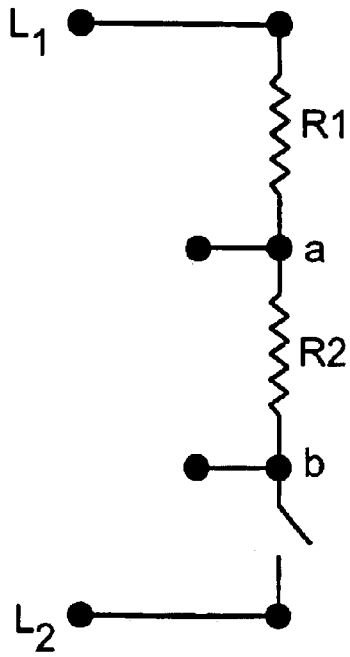
FIG. 11*a* illustrates the electrical circuit of each resistance heater system in FIG. 10 when configured for 240 Volt AC operation.
Figure 11:
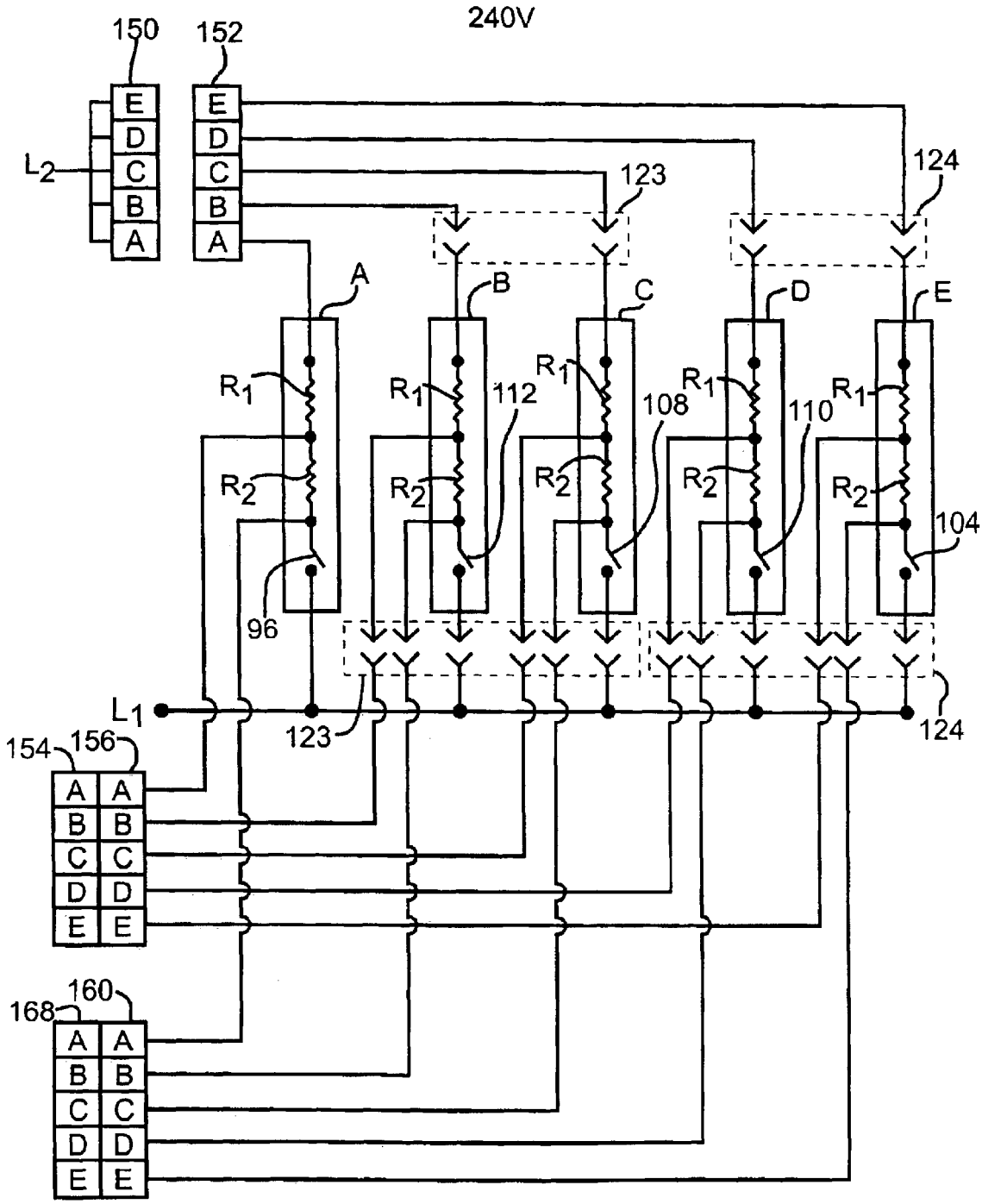
FIG. 11 presents an electrical diagram illustrating the 240 volt operation of the machine heating elements.

Turning now to FIGS. 10 and 11, letters A, B, C, D, and E represent the resistance heaters within pump body 50, supply hose 100, applicator 102, supply hose 105, and discharge applicator 107 respectively. Each resistance heater circuit comprises two, in line, resistance heating elements R1 and R2 as illustrated in FIGS. 10 and 11. FIG. 10 illustrates the wiring arrangement for 120 volt operation and FIG. 11 illustrates the wiring arrangement for 240 volt operation.

Figure 10A:
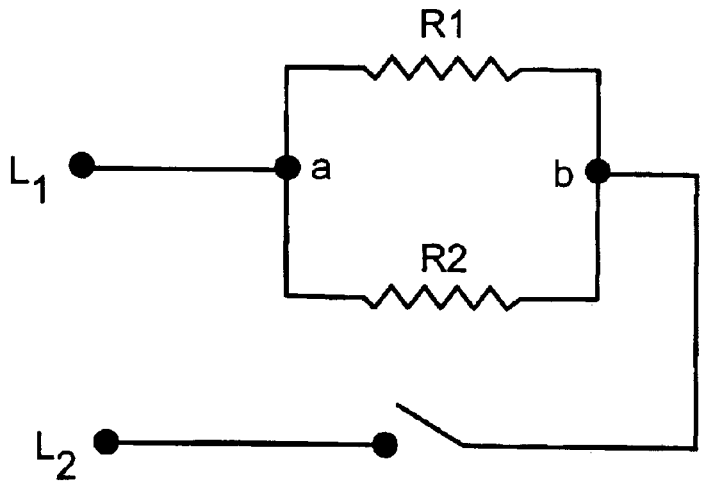
FIG. 10A illustrates the electrical circuit of each resistance heater system in FIG. 10 when configured for 120 Volt AC operation.

When the user desires to operate the hot melt machine on 120 volts, as illustrated in FIG. 10, the user plugs connector 156 into line connector 150 and connector 160 into connector 152, as illustrated. When connectors 156, 150, 160, and 152 are connected in this way, each resistive heater, A, B, C, D, and E, is wired in a parallel circuit as illustrated in FIG. 10A.

When the user desires to operate the hot melt machine on 240 volts, as illustrated in FIG. 11, the user plugs connector 152 into line connector 150, and leaves connectors 156 and 160 free and unplugged as illustrated. When configured in this way each resistive heater, A, B, C, D, and E is wired in series as illustrated in FIG. 11A. When wired to operate on 240 volts, as illustrated in FIG. 11, it is desired to plug connectors 156 and 160 into dead end connectors 154 and 168, respectively, to prevent the possibility of human contact with the otherwise electrically hot connector pins. Connectors 150, 152, 154, 156, 160 and 168 are located within control box 24.

As shown in FIGS. 10 and 11, hose 1 and applicator 1 are electrically connected to the machine using connector 123. In a similar manner, hose 2 and applicator 2 are electrically connected to the machine using connector 124. By virtue of the electrical topology disclosed in FIGS. 10 and 11, the hose and applicator peripherals, when attached, assume either a series electrical arrangement or a parallel electrical arrangement, as is appropriate for a given machine, with no modification of the peripherals themselves.

Although resistance heaters A, B, C, D, and E are shown in FIGS. 10 and 11 as each having two resistance heating elements, any number of heating elements may be employed. When employing more than two resistance heating elements the circuitry must be structured such that all resistive heating elements operate in parallel when operating on 240 volts and operate in series when operating on 120 volts.

While we have described above the principles of my invention in connection with specific embodiments, it is to be clearly understood that this description is made only by way of example and not as a limitation of the scope of my invention as set forth in the accompanying claims.

What is claimed is:

1. A hot melt adhesive application machine comprising:

a) a reservoir for containing adhesive material therein, b) a heated molten adhesive pump for pumping said adhesive from said reservoir, said pump suspended within said reservoir such that said heated pump body transfers heat directly into said adhesive material within said reservoir.

2. A hot melt adhesive application machine as claimed in claim 1 wherein said heated molten adhesive pump is driven by an air motor.

3. A hot melt adhesive application machine as claimed in claim 1 wherein said heated molten adhesive pump is heated by electrical resistance heating.

4. A hot melt adhesive application machine as claimed in claim 1 wherein heat transfer fins are conductively attached to said pump body and extend outward from said pump body into said adhesive material.

5. A hot melt adhesive application machine as claimed in claim 4 wherein a portion of said heat transfer fins circumscribe the interior wall of said reservoir.

6. A hot melt adhesive application machine as claimed in claim 5 wherein a portion of said heat transfer fins extend radially from said pump body.

7. A hot melt adhesive pump assembly comprising:

a) an elongated pump body, b) a first open ended bore extending axially through said elongated body, c) a second blind bore open at its upper end and generally parallel to said first bore, d) an electrical resistance heating element within said second bore, e) a check valve positioned within the opening of said first bore's lower end, said check valve arranged such that molten adhesive material may flow into said first bore but can not flow outward, f) at least one discharge outlet from the upper portion of said first bore, g) a pump piston slideably received within said first bore, said piston having a central cavity, opening at the bottom end of said piston thereby fluidly communicating with said first bore, h) a check valve positioned within said piston's central cavity whereby molten adhesive may flow into said central cavity, through said check valve, but not outward through said check valve, i) at least one open port extending from the top end of said piston's central cavity and into said first whereby molten adhesive may flow through said check valve, into said central cavity and into said first bore atop said piston as said piston moves downward within said first bore, j) a pump rod slidingly received within said first bore and attached, at its lower end, to said piston whereby, translation of said pump rod within said first bore moves said piston within said first bore, k) a top cover plate affixed to the top of said pump body, said top plate having an opening therein for passage of said pump rod therethrough, l) a seal at the top of said first bore sealingly surrounding said pump rod whereby molten adhesive will not exit from said first bore, m) a motor for driving said pump rod in a reciprocating motion within said first bore.

8. The hot melt adhesive pump assembly as claimed in claim 7 wherein said motor is an air operated motor operated by compressed air.

9. The hot melt adhesive pump assembly as claimed in claim 7 wherein said motor is an electric motor.

10. The hot melt adhesive pump assembly as claimed in claim 7 wherein said first bore includes a fluid relief passage way extending from the top of said first bore to the exterior environment of said pump body.

11. The hot melt adhesive pump assembly as claimed in claim 7 wherein said first bore has a lower portion and an upper portion, said upper portion having a diameter smaller than said lower portion wherein said pump rod is sized to operate within the diameter of said upper portion of said first bore and said piston is sized to operate within the diameter of said lower portion and reciprocates therein during operation of said pump, said discharge outlet being located at the top end of said lower portion of said first bore.

12. The hot melt adhesive pump assembly as claimed in claim 11 wherein said piston is a self aligning within said first bore's lower portion.

13. The hot melt adhesive pump assembly as claimed in claim 7 including at least one discharge hose fluidly attached to said discharge port, said discharge hose having a discharge applicator fluidly attached to the free end of said hose.

14. The hot melt adhesive pump assembly as claimed in claim 13 wherein said discharge hose and said discharge applicator is heated by electrical resistance heating elements.

15. The hot melt adhesive pump assembly as claimed in claim 14 wherein each said discharge hose and said discharge applicator is separately heated.

16. In a hot molten material application machine having a reservoir for containing said hot molten material and a heated pump for pumping said molten material from said reservoir, an electrical resistance heating system adaptable for use with 120 volt or 240 volt AC current comprising:

a) a first second and third terminal in series relation one to the other, b) a first resistance heating element electrically connected between said first and second terminal and a second resistance heating element electrically connected between said second and third terminal wherein:

c) for 120 volt operation, said second terminal and said third terminal are connected to line power, and d) said first terminal is connected to said third terminal whereby said first and second heating elements are thereby arranged in a parallel circuit, and e) for 240 volt operation, said first and third terminals are connected to line power, whereby said first and second heating elements are thereby arranged in a series circuit.

17. The electrical resistance heating system as claimed in claim 16 wherein a thermostatic control device is placed between said third terminal and said line connection.

18. A hot molten material application machine having a heated pump for pumping said molten material and at least one heated hose fluidly connected to said pump at one end thereof and connected to a heated molten material applicator at its other end, said pump, said hose, and said applicator each having a separate electrical resistance heating system adaptable for use with 120 volt or 240 volt AC current comprising:

a) a first second and third terminal in series relation one to the other, b) a first resistance heating element electrically connected between said first and second terminal and a second resistance heating element electrically connected between said second and third terminal wherein:

c) for 120 volt operation, said second terminal and said third terminal are connected to line power, and d) said first terminal is connected to third terminal whereby said first and second heating elements are thusly arranged in a parallel circuit, and e) for 240 volt operation, said first and third terminals are connected to line power, whereby said first and second heating elements are arranged in a series circuit.

19. The hot molten material application machine as claimed in claim 18 wherein each electrical heating system includes a thermostatic control device placed between said third terminal and said line connection.

20. A hot melt adhesive application machine comprising:

a) a reservoir for containing adhesive material therein, b) pump for pumping said adhesive from said reservoir, said pump submerged within said adhesive material, (1) said pump comprising a body mass having liquid pumping elements contained therein, c) means positioned within said pump body for heating said pump body mass whereby heat is conducted from said pump main body mass into said adhesive material.

21. The hot melt adhesive application machine as claimed in claim 20 wherein said machine further includes:

a) at least one adhesive discharge hose having a discharge applicator attached the free end of said hose, c) an independently controlled heating element within each discharge hose and discharge applicator.

22. The hot melt adhesive application machine as claimed in claim 21 wherein said heating elements within said discharge hose and said discharge applicator are separately controlled.

23. In a hot molten material application machine having a reservoir for containing said hot molten material and an electrically heated pump for pumping said molten material from said reservoir such that said heated pump body transfers heat directly into said molten material within said reservoir, an electrical resistance heating system adaptable for use with 120 volt or 240 volt AC current comprising:

a) a first second and third terminal in series relation one to the other, b) a first resistance heating element electrically connected between said first and second terminal and a second resistance heating element electrically connected between said second and third terminal wherein:

c) for 120 volt operation, said second terminal and said third terminal are connected to line power, and d) said first terminal is connected to said third terminal whereby said first and second heating elements are thereby arranged in a parallel circuit, and e) for 240 volt operation, said first and third terminals are connected to line power, whereby said first and second heating elements are thereby arranged in a series circuit.

* * * * *